US006979483B2

(12) United States Patent
Matsushima et al.

(10) Patent No.: US 6,979,483 B2
(45) Date of Patent: Dec. 27, 2005

(54) CYLINDRICAL ORNAMENTAL BODY

(75) Inventors: Hideyuki Matsushima, Toyama-ken (JP); Shozo Goto, Aichi-ken (JP)

(73) Assignee: YKK Corporation, Tokyo (JP)

( * ) Notice: Subject to any disclaimer, the term of this patent is extended or adjusted under 35 U.S.C. 154(b) by 330 days.

(21) Appl. No.: 10/021,043

(22) Filed: Dec. 19, 2001

(65) Prior Publication Data

US 2002/0081448 A1 Jun. 27, 2002

(30) Foreign Application Priority Data

Dec. 25, 2000 (JP) ..... 2000-392547

(51) Int. Cl.[7] ..... B29D 23/00

(52) U.S. Cl. ..... 428/36.9; 428/64.1; 428/542.2; 273/DIG. 14; 273/DIG. 24; 362/102; 362/202; 362/223

(58) Field of Search ..... 428/542, 64.1, 428/36.9, 542.2; 273/DIG. 24, DIG. 14; 362/202, 102, 223

(56) References Cited

U.S. PATENT DOCUMENTS 4,967,322 A * 10/1990 DuBois ..... 362/102
6,110,558 A * 8/2000 Billingsley et al. ..... 428/67

* cited by examiner

*Primary Examiner*—Deborah Jones
*Assistant Examiner*—Abraham Bahta
(74) *Attorney, Agent, or Firm*—Finnegan, Henderson, Farabow, Garrett & Dunner, L.L.P.

(57) ABSTRACT

A cylindrical ornamental body can protect a reflective member from being damaged and reducing production cost. The cylindrical ornamental body comprises a transparent cylindrical main body made of synthetic resin and a reflective member having a reflective face inserted into said cylindrical main body. An air layer is provided between the reflective face of the reflective member and an inner wall of the cylindrical main body. The reflective member is composed of a belt-like member having the reflective face on at least one face thereof and has a fixing portion which is fixed to the inner wall of the cylindrical main body at least along a side edge in the length direction thereof. A attaching portion may be provided integrally on part of an outer side face of the cylindrical main body along a longitudinal direction of the cylindrical main body.

5 Claims, 10 Drawing Sheets

CYLINDRICAL ORNAMENTAL BODY

BACKGROUND OF THE INVENTION

1. Field of the Invention

The present invention relates to a cylindrical ornamental body for use in fringe ornament or the like to be attached to a strap, bag or the like.

2. Description of the Related Art

Conventionally, some long ornamental bodies for use in a fringe ornament to be attached to a strap, bag or the like have a retroreflection effect. In this ornamental body, a strap-like core material is provided in the center of a long and narrow retroreflective film such that it extends in the longitudinal direction. Then, the retroreflective film is folded in the center of the longitudinal direction thereof and bonded together such that its reflective face is exposed outside. This bonded portion serves as an attaching portion which is sewed to other member. As for use method of this ornamental body, the attaching portion formed of the retroreflective film is sewed to a position corresponding to an edge of cloth for use, so that the retroreflective film covering the outside of the core member is exposed outside the edge of the cloth, thereby exerting an ornamental effect.

In the above-described conventional technology, because the retroreflective film is exposed outside the core material, the retroreflective layer is likely to be damaged, so that the retroreflective effect deteriorates easily. Further, because the attaching portion is formed of the retroreflective film, the retroreflective film, which is relatively expensive, is often wasted, leading to increase of production cost.

SUMMARY OF THE INVENTION

Accordingly, the invention has been achieved in views of the above-described problems and therefore, an object of the invention is to provide a cylindrical ornamental body capable of protecting the reflective member from being damaged and reducing production cost.

According to the invention, the cylindrical ornamental body comprises a transparent cylindrical main body made of synthetic resin and a reflective member having a reflective face such as a retroreflective layer inserted into the cylindrical main body. An air layer is provided between the reflective face of the reflective member and an inner wall of the cylindrical main body. The reflective member is composed of a belt-like member having the reflective face on at least one face thereof. The reflective member has a fixing portion which is fixed to the inner wall of the cylindrical main body at least along a side edge in the longitudinal direction thereof. Further, an attaching portion may be provided integratedly on part of an outer side face of the cylindrical main body along the longitudinal direction of the cylindrical main body.

If the cylindrical ornamental body of the invention is irradiated with sunlight or headlight of an automobile, the reflective face of the reflective member reflects light, so that this light passes through the cylindrical main body and is recognized visibly. Because the reflective member is a belt-like member and includes the air layer provided between the inner wall of the cylindrical main body and the reflective member, retroreflective effect and the like can be exerted even when the cylindrical body is broken or bent.

DESCRIPTION OF THE PREFERRED EMBODIMENTS

Figure 1:
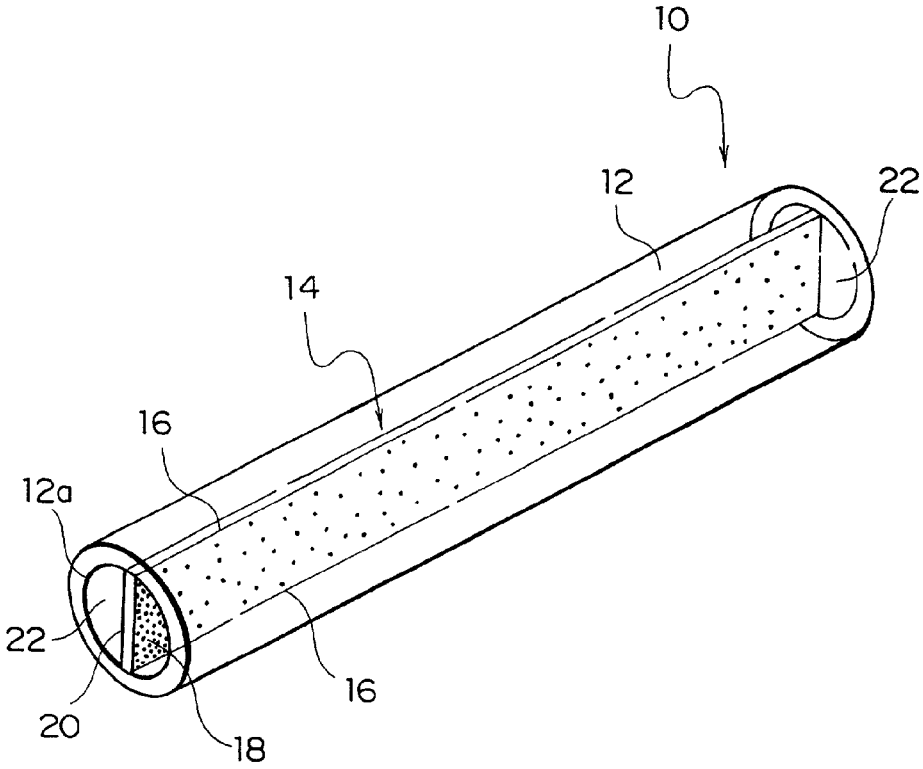
FIG. 1 is a perspective view of a cylindrical ornamental body according to a first embodiment of the invention.
Figure 2:
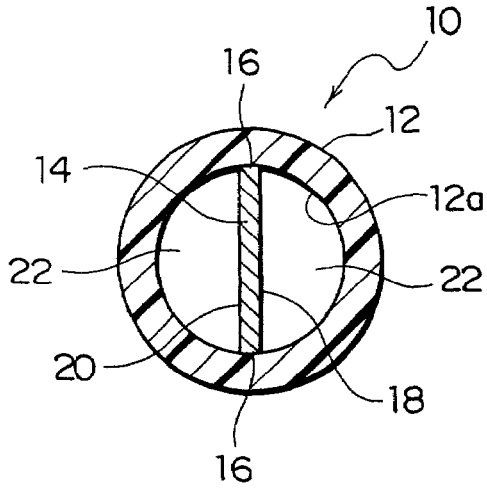
FIG. 2 is a longitudinal sectional view of the cylindrical ornamental body of this embodiment.

Hereinafter, the preferred embodiments of the invention will be described with reference to the accompanying drawings. FIGS. 1 and 2 show a cylindrical ornamental body 10 according to a first embodiment of the invention. This cylindrical ornamental body 10 is formed of a cylindrical main body 12, which is a long cylinder made of a transparent resin material such as polyurethane, soft vinyl chloride, polypropylene, and ethylene vinyl acetate. Then, a belt-like reflective member 14 is inserted into the cylindrical main body 12. The reflective member 14 is formed in belt-like form with arbitrary substrate such as resin and cloth and has a reflective face 18, in which a retroreflective layer is formed, on a side face parallel to the cylindrical main body 12. The other side face parallel to the reflective face 18 is a non-reflective face 20 in which the substrate or the like is exposed. A pair of end faces located at right angle to the reflective face 18 while parallel to the cylindrical main body 12 of the reflective member 14 serve as fixing portions 16, so that they are fixed to an inner wall 12*a* of the cylindrical main body 12. The fixing positions are a pair of portions, which oppose each other in the diameter direction of the cylindrical main body 12, so that the reflective face 18 of the fixed reflective member 14 is situated in the cylindrical main body 12 in the diameter direction thereof. Consequently, a space is formed between the inner wall 12*a* of the cylindrical main body 12 and the reflective member 14, so that the reflective face 18 and the non-reflective face 20 located on an opposite side thereof are respectively provided via an air layer 22.

Next, a manufacturing method of the cylindrical ornamental body 10 of this embodiment will be described. The cylindrical body 12 is formed continuously by extrusion mold and at the same time, the reflective member 14 is inserted into an inner side of the extruded cylindrical main body 12. The cylindrical main body 12 just after the extrusion keeps a high plasticity before being hardened so that the fixing portions 16 on both side end faces of the reflective member 14 make contact with the inner wall 12*a* of the cylindrical main body 12 and are fixed thereto at the same time when the cylindrical main body 12 is hardened. Additionally, upon this fixing, air is fed into the inner side of the cylindrical main body 12 so as to prevent the reflective member 14 from deflecting.

As for a use method of the cylindrical ornamental body 10 of this embodiment, the cylindrical ornamental body 10 is cut to an arbitrary length and a predetermined metal, attaching member or the like is attached thereon, so that this is used as a strap of a portable phone, camera or the like and other strap members.

According to this embodiment, because the reflective member 14 is accommodated in the cylindrical main body 12 of the cylindrical ornamental body 10, it never contacts other member or gets well, so that the reflective face 18 is protected thereby maintaining a high retroreflective effect. Further, because the reflective member 14 is fixed in the diameter direction of the cylindrical main body 12 and there is provided the air layer 22 between the reflective member 14 and the inner wall 12*a* of the cylindrical main body 12, the reflective face 18 never contacts the cylindrical main body 12 even if the cylindrical main body 12 is bent, so that retroreflection can be secured. Further, because the fixing portions 16 of the reflective member 14 are fixed on the inner wall of the cylindrical main body, the reflective member 14 never slips out of the cylindrical main body 12, thereby ensuring the safety.

Figure 3:
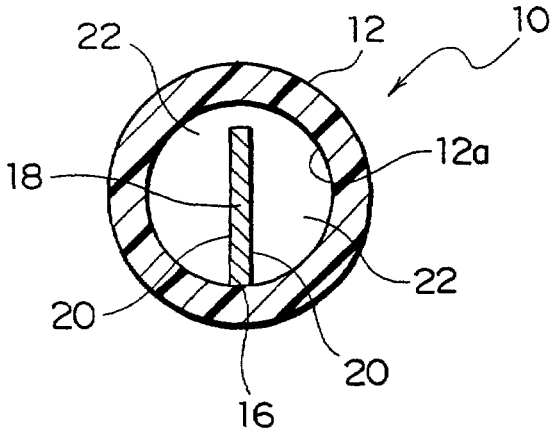
FIG. 3 is a longitudinal sectional view of a modification of the cylindrical ornamental body of this embodiment.

Meanwhile, the cylindrical ornamental body 10 of this embodiment may be so constructed that as shown in FIG. 3, only one end portion of the reflective member 14 serves as the fixing portion 16 so that it is fixed to the inner wall 12*a* of the cylindrical main body 12 while the other end portion is kept free.

Figure 4:
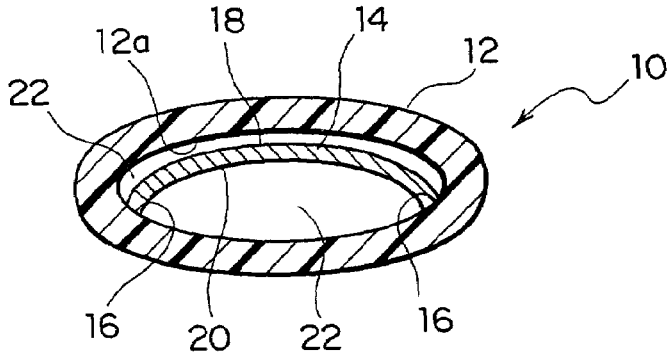
FIG. 4 is a longitudinal sectional view of another modification of the cylindrical ornamental body of this embodiment.

Further, the cylindrical ornamental body 10 of this embodiment may be so formed that the sectional shape of the cylindrical main body 12 is oval as shown in FIG. 4. The reflective member 14 is provided in the direction of major axis of the section of the cylindrical main body 12, the reflective face 18 is located such that it is curved along the inner wall 12*a* of the cylindrical main body 12 and the fixing portions 16 on both ends are fixed to an inner face of the cylindrical main body 12. In this case, because the reflective face 18 of the reflective member 14 is curved along the inner face of the cylindrical main body 12, the reflective face 18 is easy to recognize visually.

Figure 5:
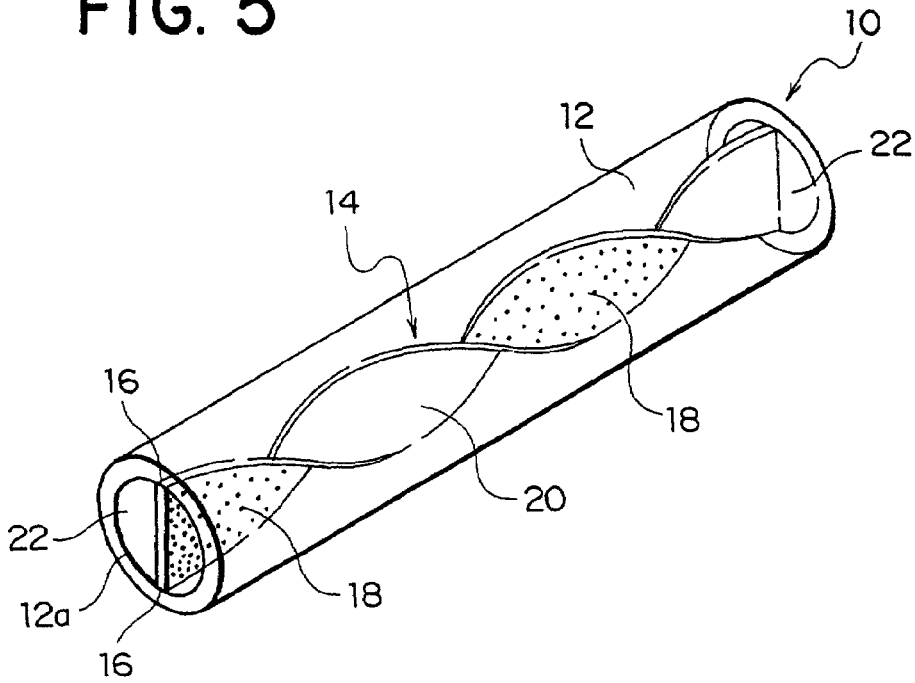
FIG. 5 is a perspective view of still another modification of the cylindrical ornamental body of this embodiment.

Further, in the cylindrical ornamental body 10 of this embodiment, the reflective member 14 may be twisted spirally as shown in FIG. 5 and fixed to the inner wall 12*a* of the cylindrical main body 12. In this case, the reflective face 18 of the reflective member 14 appears intermittently so that retroreflection occurs like a dotted line.

Figure 6:
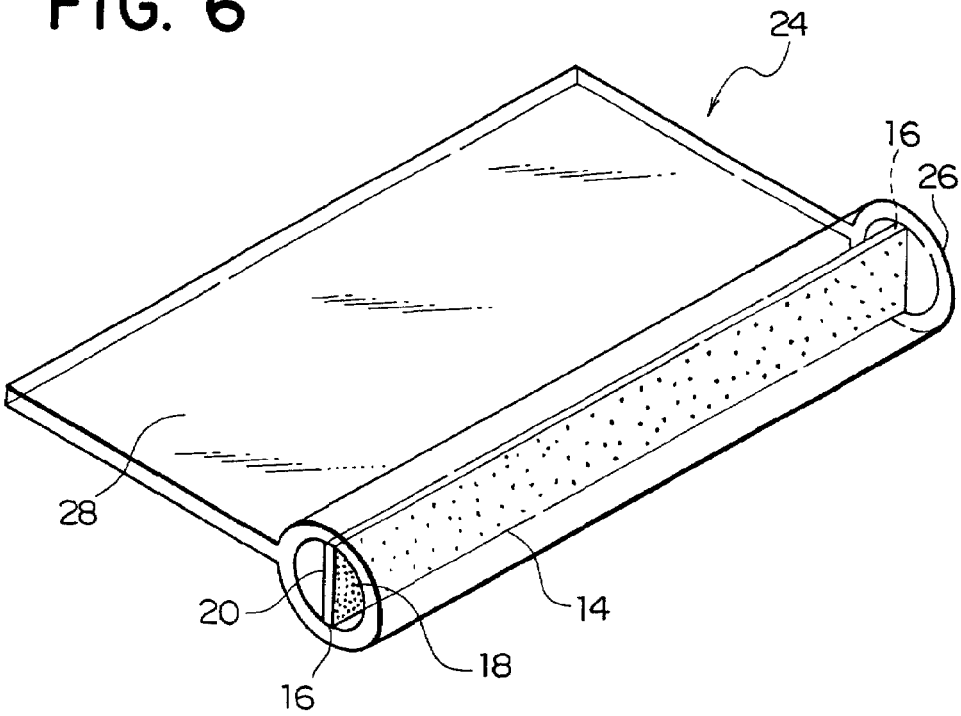
FIG. 6 is a perspective view of the cylindrical ornamental body according to a second embodiment of the invention.
Figure 7:
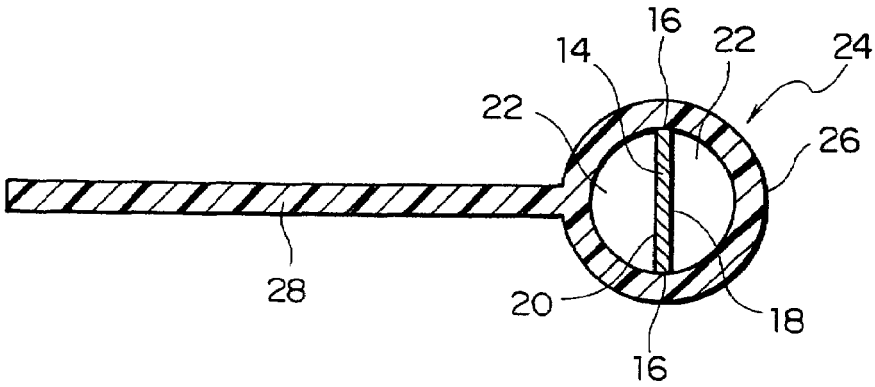
FIG. 7 is a longitudinal sectional view of the cylindrical ornamental body of this embodiment.

Next, a second embodiment of the invention will be described with reference to FIGS. 6 and 7. Here, identical reference numerals are attached to the same members as the above-described embodiment and a description therefor is omitted. In a cylindrical ornamental body 24 of this embodiment, a cylindrical main body 26, which is a long cylinder made of transparent resin material like the above-described embodiment, is provided and a plate-like attaching portion 28 is formed integrally along the longitudinal direction of the cylindrical main body 26 on an outer side face of the cylindrical main body 26. Then, the belt-like reflective member 14 is inserted into and fixed to the inner side of the cylindrical main body 26. The reflective member 14 is fixed at right angle to a surface of the attaching portion 28 and an opposite face with respect to the attaching portion 28 of the reflective member 14 is the reflective face 18 while the other side face is the non-reflective face 20.

Figure 8:
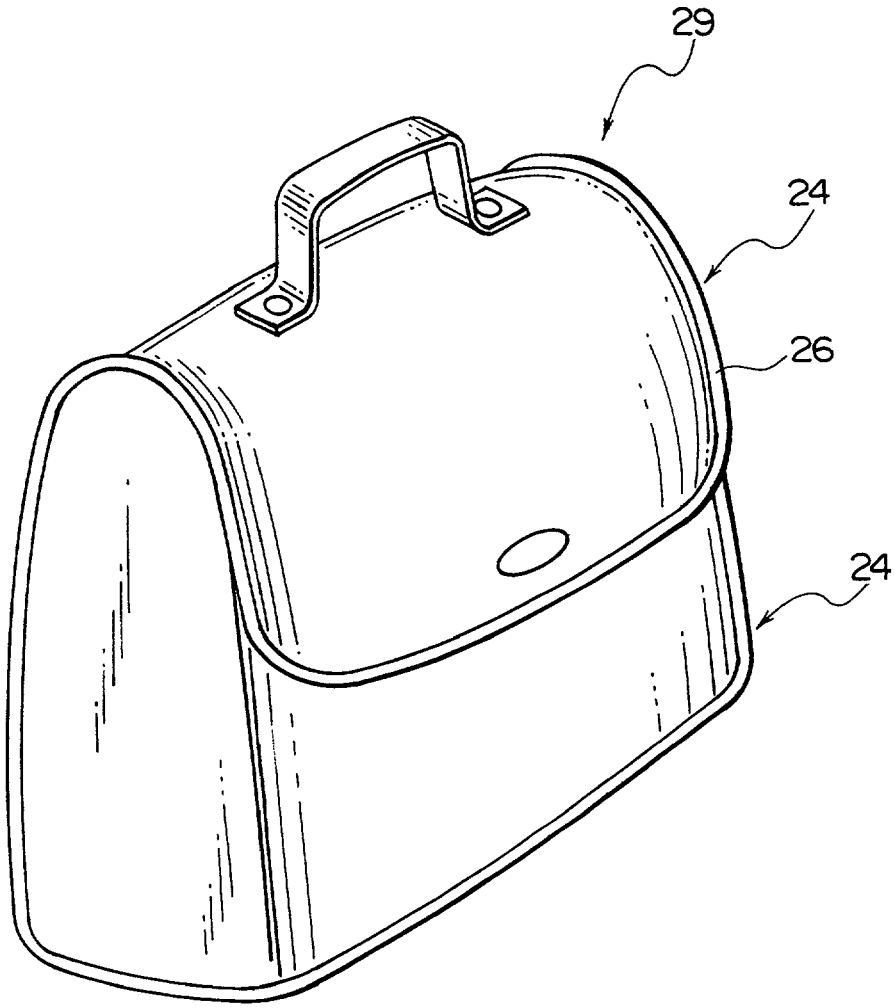
FIG. 8 is a perspective view showing a use condition of the cylindrical ornamental body of this embodiment.
Figure 9:
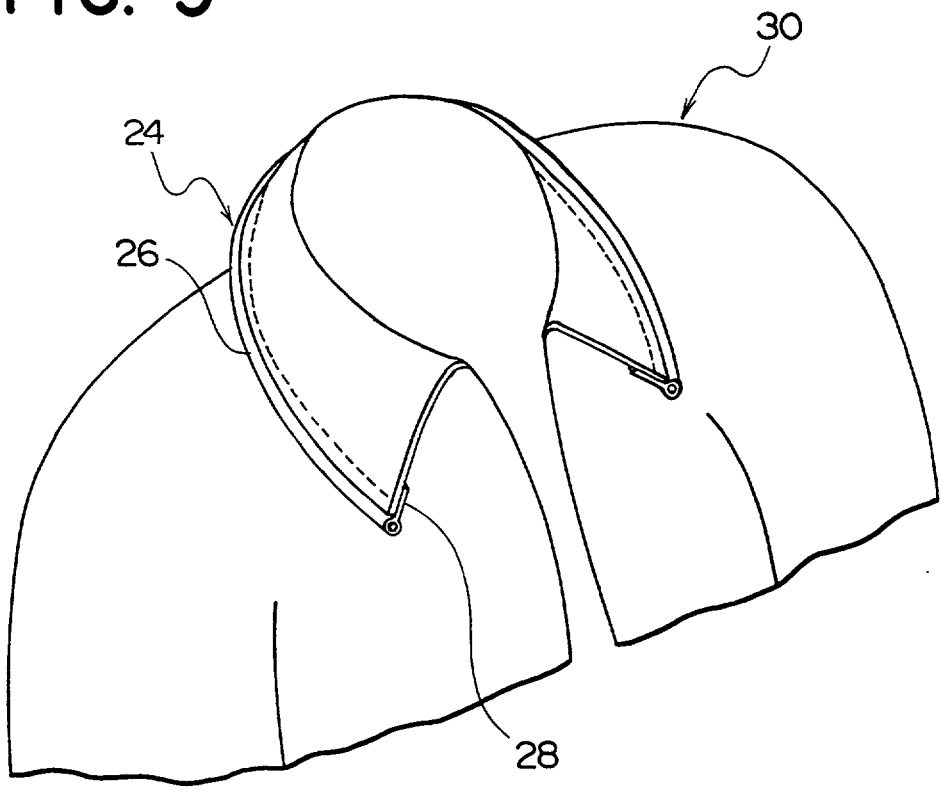
FIG. 9 is a perspective view showing another use condition of the cylindrical ornamental body of this embodiment.
Figure 10:
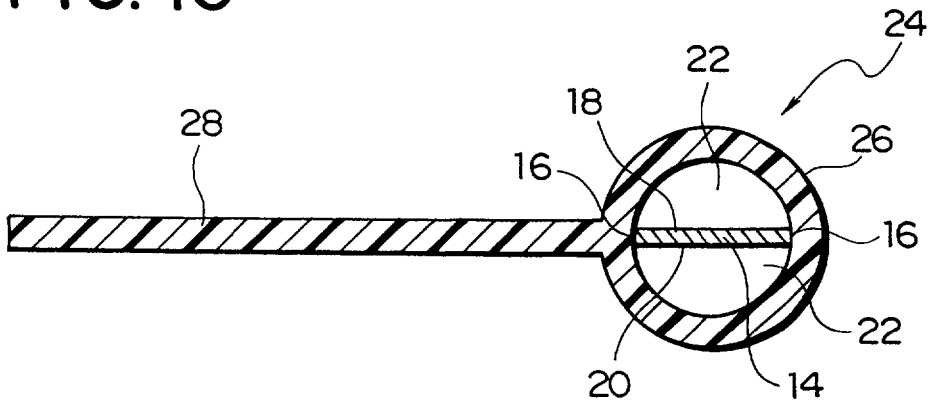
FIG. 10 is a longitudinal sectional view showing a modification of the cylindrical ornamental body of this embodiment.

The cylindrical ornamental body 24 of this embodiment is employed as fringe ornament of a bag 29 as shown in FIG. 8. As for the manufacturing method, first, the cylindrical ornamental body 24 is cut to a desired length and then, the attaching portion 28 of the cylindrical ornamental body 24 is nipped with a pair of cloths when the bag 29 is sawed and attached to the bag by sawing together with the cloths. Further, this cylindrical ornamental body 28 may be sewed together as ornament on a fringe of clothes 30 as shown in FIG. 9. Meanwhile, the attaching portion 28 may be fixed to the bag 29 and the clothes 30 by not only sewing together but also by fusing, bonding or the like.

The cylindrical ornamental body 24 of this embodiment can be attached on the bag 29 or the clothes 30 securely and easily, because the attaching portion 28 is provided, so that it serves as a fringe ornament.

Meanwhile, the cylindrical ornament 24 of this embodiment may be so constructed that the reflective face 18 of the reflective member 14 is parallel to the surface of the attaching portion 28. In this case, because this reflective face 18 is located at a position, which is recognized from a perpendicular direction with respect to the attaching portion 28, and the reflective face 18 opposes the seeing direction, it is possible to secure a sufficient retroreflective effect in that direction.

Figure 11:
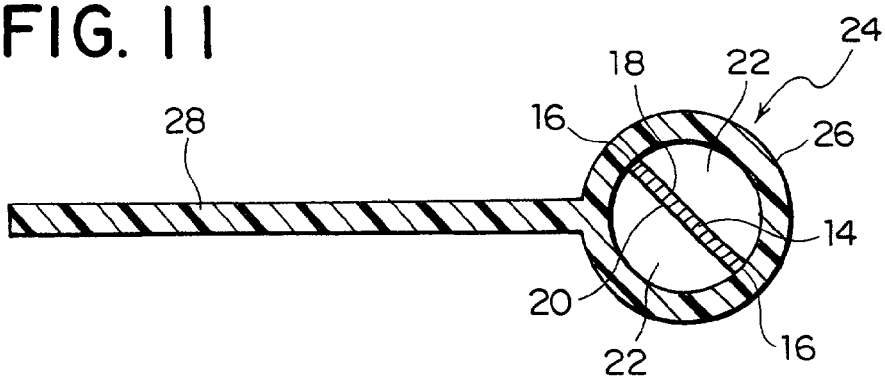
FIG. 11 is a longitudinal sectional view showing another modification of the cylindrical ornamental body of this embodiment.

Further, the cylindrical ornamental body 24 of this embodiment may be provided such that the reflective member 14 intersects the surface of the attaching portion 28 at any angle as shown in FIG. 11. In this case, the reflective face 18 is recognized visually from both directions perpendicular to and parallel to the surface of the attaching portion 28.

Figure 12:
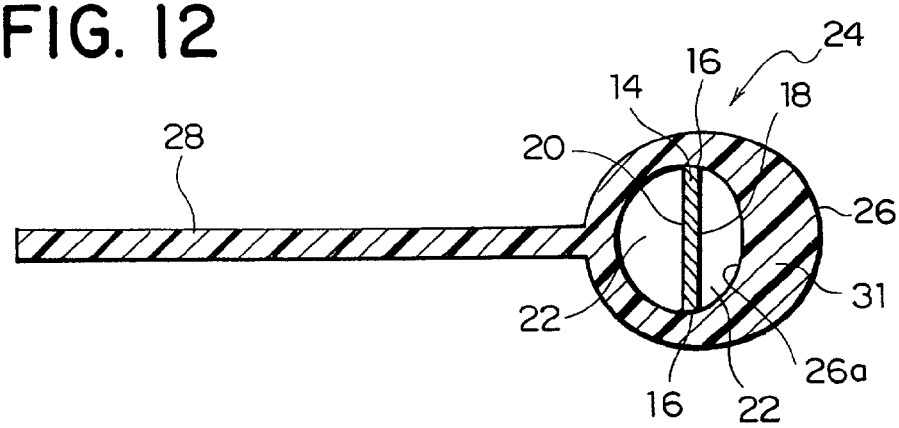
FIG. 12 is a longitudinal sectional view showing still another modification of the cylindrical ornamental body of this embodiment.

The cylindrical ornamental body 24 of this embodiment may be so constructed that a thick portion 31 is provided on a portion opposite to the attaching portion 28 of the cylindrical main body 26 as shown in FIG. 12. The thick portion 31 is formed such that the side face of the cylindrical main body 26 is thick, so that an inner wall 26*a* of the cylindrical main body 26 is located near the center of the cylindrical main body 26. The reflective member 14 is fixed to the attaching portion 28 at right angle and a face opposite to the attaching portion 28 of this reflective member 14 is the reflective face 18 while the other face is the non-reflective face 20.

Because the thick portion 31 exerts the effect as a convex lens in this case, the reflective face 18 looks larger, so that it can be easy to recognize visually. Particularly, if there are characters, symbols or the like on the reflective face 18, visibility to them may be improved.

Figure 13:
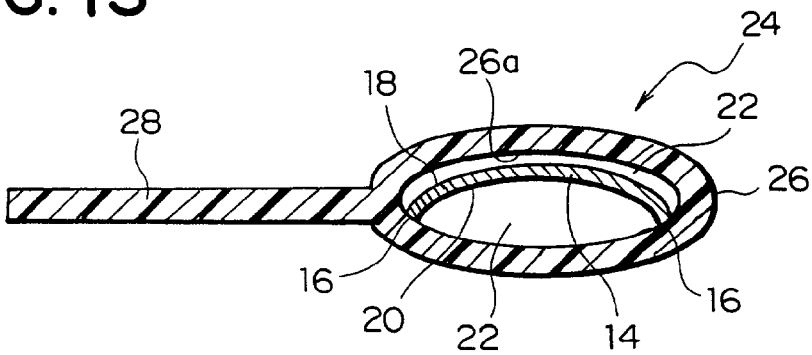
FIG. 13 is a longitudinal sectional view showing still another modification of the cylindrical ornamental body of this embodiment.

Further, the cylindrical ornamental body 24 of this embodiment may be formed such that as shown in FIG. 13, the sectional shape of the cylindrical main body 26 is oval while a direction parallel to the attaching portion 28 is longer. The reflective member 14 is provided along the direction of the major axis in the section of the cylindrical main body 26, and the reflective face 18 is fixed therein such that it is curved along the inner wall 26*a* of the cylindrical main body 26. Because the reflective member 14 is curved along the inner wall 26*a* in this case, the reflective face 18 is easy to recognize visually.

Figure 14:
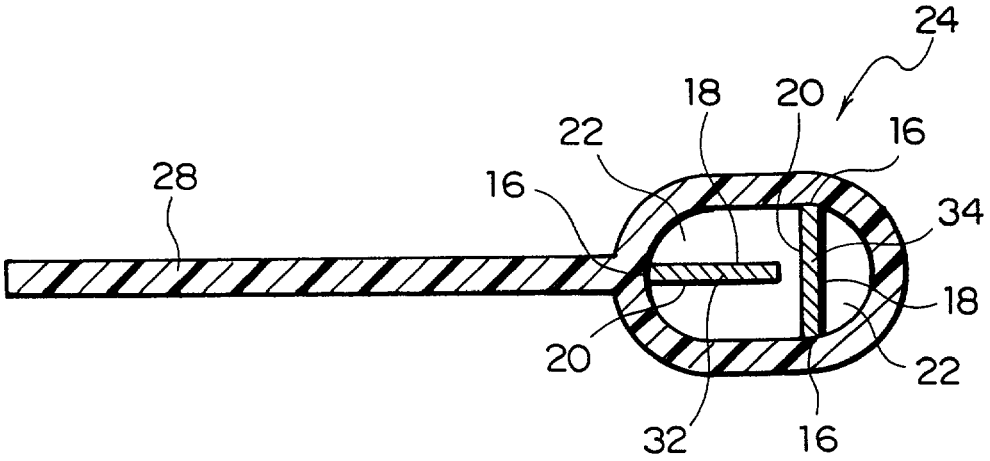
FIG. 14 is a longitudinal sectional view showing still another modification of the cylindrical ornamental body of this embodiment.

Further, the cylindrical ornamental body 24 of this embodiment may be so constructed that as shown in FIG. 14, the sectional shape of the cylindrical main body 26 is formed in the shape of an elongated circle whose one direction parallel to the attaching portion 28 is longer. Then, it is permissible to provide a first reflective member 32 parallel to the attaching portion 28 and a second reflective member 34 at right angle to the first reflective member 32, in the cylindrical main body 26. In this case, the reflective face 18 can be seen in any directions perpendicular to the attaching portion 28 and parallel thereto.

Figure 15:
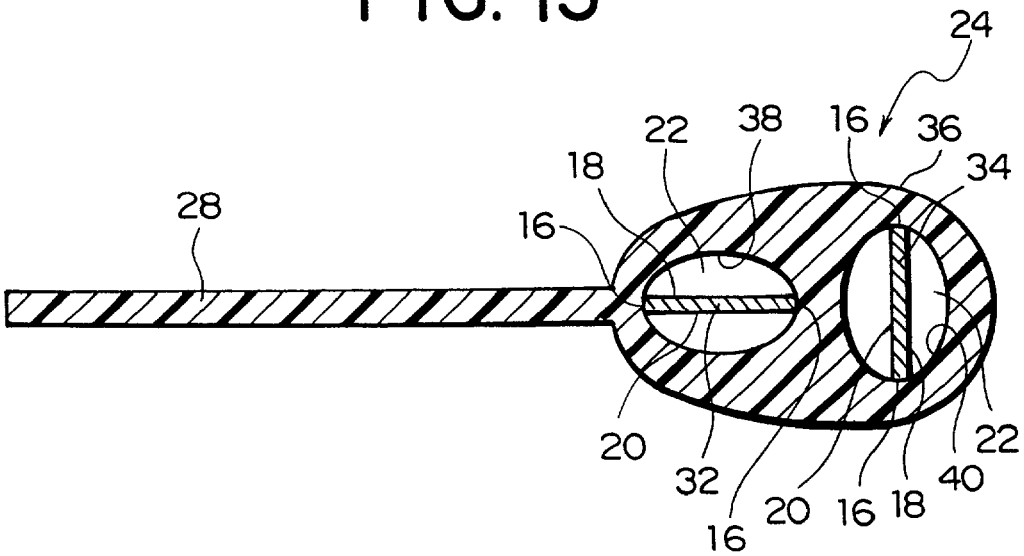
FIG. 15 is a longitudinal sectional view showing still another modification of the cylindrical ornamental body of this embodiment.

Further, the cylindrical ornamental body 24 of this embodiment may be so constructed that as shown in FIG. 15, two cylindrical hallow portions 38, 40 are formed through along the longitudinal direction of the cylindrical main body 36. The hallow portion 38 nearer the attaching portion 28 is formed in the shape of an oval whose one direction parallel to the attaching portion 28 is longer and the first reflective member 32 is provided inside the hallow portion 38 along the direction of the major axis of the hallow portion 38. On the other hand, the hallow portion 40 located apart from the attaching portion 28 is formed in the shape of an oval whose one direction at right angle to the attaching portion 28 is longer and the second reflective member 34 is provided inside the hallow portion 40 along the direction of the major axis of the hallow portion 40. In this case, the reflective face 18 can be seen in any direction of the direction at right angle to the attaching portion 28 and the direction parallel thereto. Further, because both end portions of the first reflective member 32 and the second reflective member 34 are respectively fixed to the inner walls of the hallow portions 38, 40, the direction of the reflective face 18 is stabilized.

Figure 16:
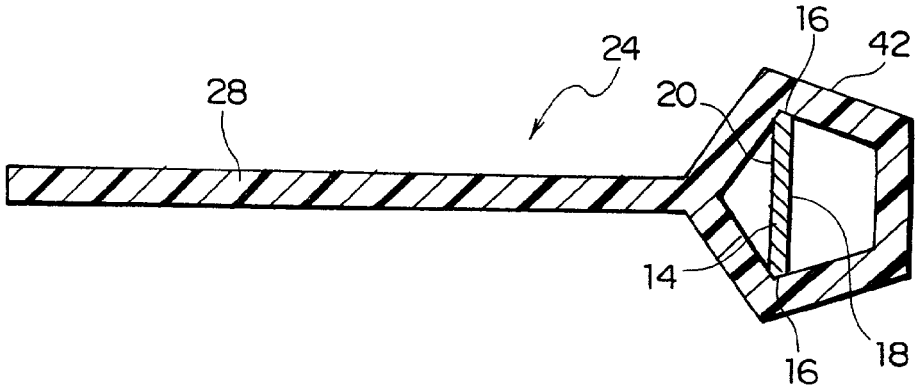
FIG. 16 is a longitudinal sectional view showing still another modification of the cylindrical ornamental body of this embodiment.

Further, the cylindrical ornamental body 24 of this embodiment may be so constructed that as shown in FIG. 16, the sectional shape of the cylindrical main body 42 is formed in a pentagon shape or other polygon shape. Then, the reflective member 14 is provided at right angle to the attaching portion 28 and an opposite side face with respect to the attaching portion 28 serves as the reflective face 18.

Figure 17:
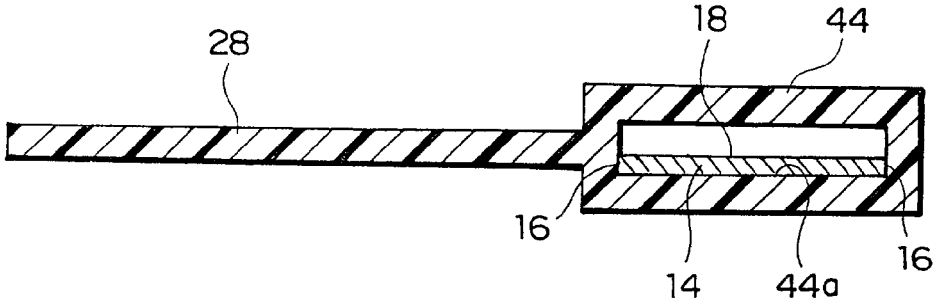
FIG. 17 is a longitudinal sectional view showing still another modification of the cylindrical ornamental body of this embodiment.

Furthermore, the cylindrical ornamental body 24 of this embodiment may be so constructed that as shown in FIG. 17, the sectional shape of the cylindrical main body 44 is in a rectangular shape. An inner face 44*a* parallel to the attaching portion 28 of the reflective member 14 is fixed to an inner face of the cylindrical main body 44 and the reflective face 18 is provided on an opposite side to the inner face 44*a*.

Such a cylindrical ornamental body includes a hallow pipe made of transparent soft resin and a round strap-like reflective member coated with glass beads is inserted inside this hallow pipe. Because air layer is needed between the hallow pipe and the reflective member for the reflective member to exert its retroreflective effect, a diameter of the reflective member is formed smaller than the inner diameter of the hallow pipe.

Figure 18:
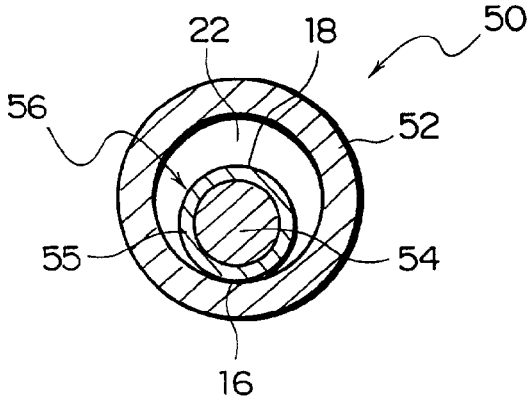
FIG. 18 is a longitudinal sectional view of the cylindrical ornamental body according to a third embodiment of the present invention.

Next, a third embodiment of the invention will be described with reference to FIG. 18. Here, identical reference numerals are attached to the same members as the above-described embodiments and a description therefor is omitted. In a cylindrical ornamental body 50 of this embodiment, a cylindrical main body 52, which is a long cylinder made of transparent resin material like the above-described embodiments, is provided and a reflective member 56 formed by winding a reflective film 55 on an outer side face of a strap-like core member 54 is inserted inside the cylindrical main body 52. Because the outer diameter of the reflective member 56 is smaller than an inner diameter of the cylindrical main body 52, when the reflective member 56 is inserted through the cylindrical main body 52, a space 22 is formed inside the cylindrical main body 52. Further, part of the reflective member 56 is fixed to an inside wall of the cylindrical main body 52 along the longitudinal direction a side face of the reflective member 56.

The cylindrical ornamental body 50 of this embodiment can be formed by fixing the strap-like reflective member 56 inside the cylindrical main body 52 in the same process as the above-described embodiments. Then, the cylindrical ornamental body 50 of this embodiment may be employed appropriately as strap-like members.

Meanwhile, the cylindrical ornamental body of this invention is not restricted to the above-described embodiments, but material of the reflective face of the reflective member may be changed freely. The reflective face may be provided with a retroreflective material, light accumulation material, fluorescent material, metallic thin film or other reflective material or include a retroreflective layer, a light accumulating layer, a fluorescent layer, a metallic layer or the like on its surface.

Figure 19:
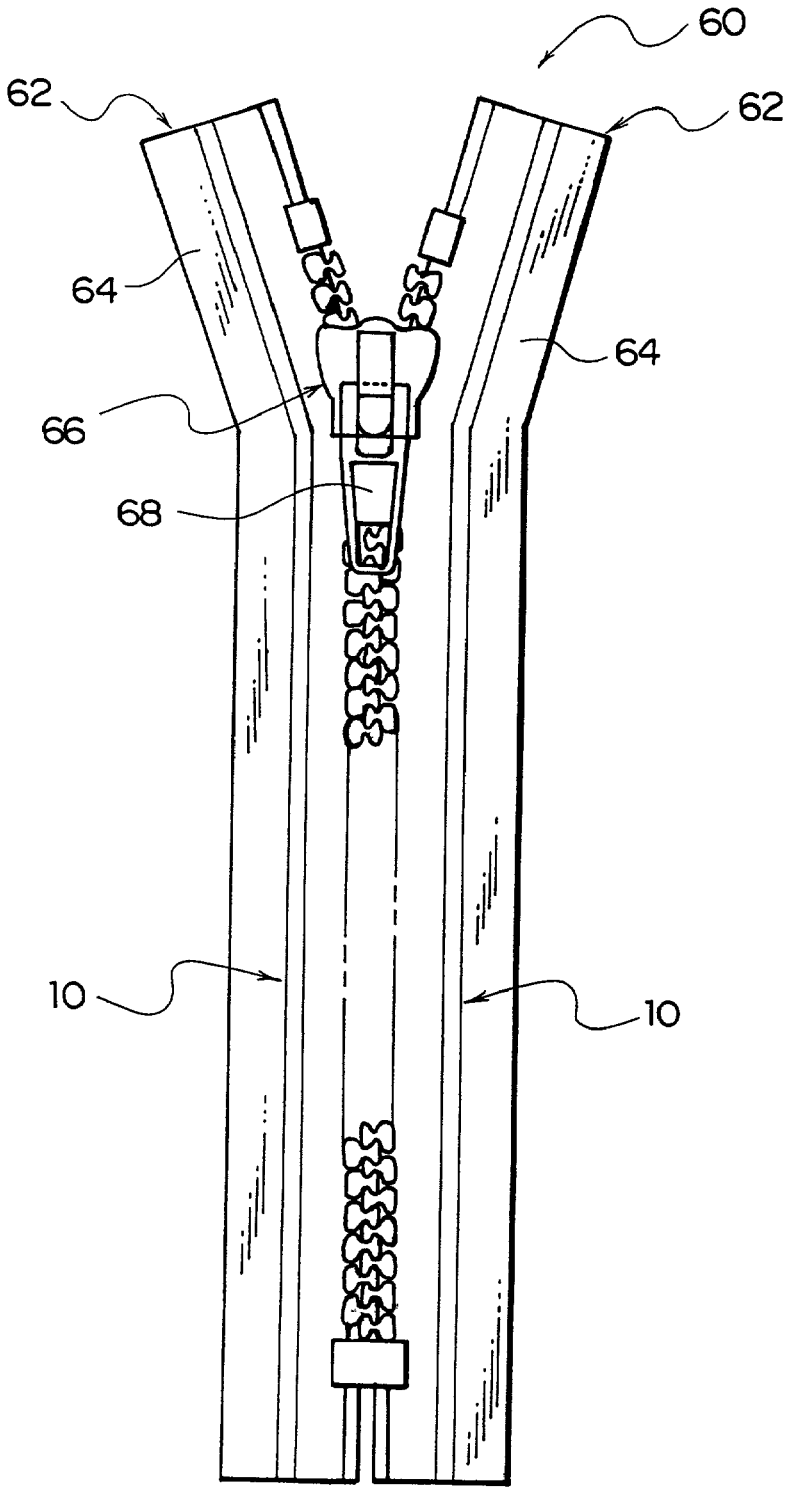
FIG. 19 is a front view showing another use example of the cylindrical ornamental body of the invention.

Use of the cylindrical ornamental body of the invention is not restricted to the above-described embodiments, but as shown in FIG. 19, it is permissible to weave or knit the cylindrical ornamental body 10 into the weaving structure or the knitting structure of a fastener tape 64 on the surface of a fastener stringer 62 of a slide fastener 60 so as to provide an ornamental effect. Consequently, the fastener tape 64 can be provided with an appropriate degree of stiffness and elasticity thereby improving operability of the slider 66. The attaching position of the cylindrical ornamental body 10 may be of any position as long as it allows to exert the ornamental effect and other functions without obstructing operations of the slider 66 and a pull 68.

The cylindrical ornamental body 10 of the invention allows the reflective member 14 to be attached inside the cylindrical main body 12 securely with such a simple structure. Further, by providing the reflective member 14 inside the cylindrical main body 12, the reflective member 14 can be prevented from being damaged and further, production cost can be reduced. A secure reflection effect can be obtained by fixing the reflective member 14 inside the cylindrical main body 12 through the air layer 22. Further, by providing the attaching portion 28 integrally with the cylindrical main body 12, this cylindrical ornamental body 10 can be attached to other product easily.

What is claimed is:

1. A cylindrical ornamental body comprising a transparent cylindrical main body made of soft synthetic resin and a reflective member having a reflective face inserted into said cylindrical main body, wherein said cylindrical main body further comprises a flat attaching portion having a first end and a second end, the first end being integrally formed on part of an outer side face of said cylindrical main body along a longitudinal direction of the cylindrical main body, the second end being formed to extend in a direction away from the cylindrical main body.

2. A cylindrical ornamental body according to claim 1, wherein an air layer is provided between said reflective face of said reflective member and an inner wall of said cylindrical main body.

3. A cylindrical ornamental body according to claim 1, wherein said reflective member is composed of a belt-shaped member having the reflective face on at least one face thereof.

4. A cylindrical ornamental body according to claim 3, wherein said reflective member has a fixing portion which is fixed to the inner wall of the cylindrical main body at least along a side edge in a longitudinal direction thereof.

5. A cylindrical ornamental body according to claim 1 wherein said reflective face of said reflective member has a retroreflective layer.

* * * * *